US006720923B1

(12) United States Patent
Hayward et al.

(10) Patent No.: US 6,720,923 B1
(45) Date of Patent: Apr. 13, 2004

(54) ANTENNA DESIGN UTILIZING A CAVITY ARCHITECTURE FOR GLOBAL POSITIONING SYSTEM (GPS) APPLICATIONS

(75) Inventors: Roger Hayward, San Francisco, CA (US); Richard Fuller, Campbell, CA (US); John Glissman, Redwood City, CA (US); Noel Marshall, Sebastopol, CA (US)

(73) Assignee: Stata Labs, LLC, Palo Alto, CA (US)

( * ) Notice: Subject to any disclaimer, the term of this patent is extended or adjusted under 35 U.S.C. 154(b) by 0 days.

(21) Appl. No.: 09/953,455

(22) Filed: Sep. 14, 2001

Related U.S. Application Data

(60) Provisional application No. 60/232,634, filed on Sep. 14, 2000.

(51) Int. Cl.[7] ..... H01Q 1/38

(52) U.S. Cl. ..... 343/700 MS; 343/702; 343/718

(58) Field of Search ..... 343/700 MS, 718, 343/780, 720, 846, 848

(56) References Cited

U.S. PATENT DOCUMENTS 5,486,837 A * 1/1996 Miller ..... 343/780
5,537,123 A * 7/1996 Mandai et al. ..... 343/700 MS
5,585,810 A * 12/1996 Tsuru et al. ..... 343/745
5,627,551 A * 5/1997 Tsuru et al. ..... 343/700 MS
5,760,745 A 6/1998 Endo et al.
5,861,854 A * 1/1999 Kawahata et al. ... 343/700 MS
5,929,813 A 7/1999 Eggleston
6,295,030 B1 * 9/2001 Kozakai et al. ..... 343/700 MS
6,404,394 B1 * 6/2002 Hill ..... 343/700 MS
6,417,809 B1 * 7/2002 Kadambi et al. ..... 343/702
6,433,743 B1 * 8/2002 Massey et al. ..... 343/700 MS
6,433,746 B2 * 8/2002 Kushihi et al. ..... 343/700 MS

* cited by examiner

*Primary Examiner*—Tan Ho
(74) *Attorney, Agent, or Firm*—Townsend and Townsend and Crew LLP

(57) ABSTRACT

An antenna arrangement for a GPS signal processing device having a circuit board is disclosed. In a preferred embodiment of the invention, the arrangement comprises an antenna member mounted to the circuit board. The antenna member includes a first surface, second surface and a third surface. The third surface adjoins the first and second surfaces. The first, second and third surfaces define a cavity within which is disposed dielectric material. At least one conductive connector comprising first and second ends is in communication with the antenna member first surface. An amplifier is in communication with each conductive connector second end.

31 Claims, 6 Drawing Sheets

ANTENNA DESIGN UTILIZING A CAVITY ARCHITECTURE FOR GLOBAL POSITIONING SYSTEM (GPS) APPLICATIONS

CROSS-REFERENCES TO RELATED APPLICATIONS

This application is related to and claims benefit of U.S. patent application Ser. No. 60/232,634, entitled "An Antenna Design Utilizing A Cavity Architecture For Global Positioning System (GPS) Applications," filed Sep. 14, 2000, which is hereby incorporated by reference in its entirety.

BACKGROUND OF THE INVENTION

The present invention relates to antennas for receiving GPS signals. In particular, the present invention relates to GPS antennas that are optimized for use in proximity to a human body.

Navigation is key to national and international industry, commerce, and safety. Knowledge of position, both relative and absolute has been used throughout history to gain tactical advantage in both peaceful and not so peaceful pursuits. From the rudimentary techniques developed over two millennia ago, people all over the world have made both evolutionary and revolutionary progress in the business of knowing their position. Navigation progressed from simple piloting—the art of connecting known points—to satellite-based navigation systems.

Today the premier worldwide navigation solution is the Global Positioning System (GPS). This satellite-based navigation system was developed by the Department of Defense (DoD) to support a variety of military operations. This system has been used in a variety of civilian systems. As the adoption of satellite-based navigation technology has grown since its introduction in the early 1980's, so has the number and complexity of devices for personal navigation and location. GPS is broken down into three basic segments, as follows: 1) space—comprising the satellites; 2) control—incorporating tracking and command centers; and 3) user—performing navigation functions based on ranging to the satellites.

The space segment contains the GPS Space Vehicles (SVs) placed in circular orbits with 55° inclination and a semi-major axis of 26,560 km (20,182 km altitude) corresponding to an orbital period of 12 hours sidereal. There are six orbit planes placed at 60° offsets in longitude with nominally four satellites in each plane, giving 24 satellites. Currently there are 28 active satellites in the planes. Spacing within the plane is adjusted to achieve optimal coverage over regions of interest. The satellites themselves are three-axis stabilized and use solar panels to provide power. Each satellite contains a pair of atomic clocks (for redundancy) which have a stability of 1 part in 1013. Each satellite broadcasts on two frequencies, 1575.42 MHz (L1) and 1278.6 MHz (L2). The L1 signal contains two separate pseudo-random noise (PRN) modulations: 1) the Clear Acquisition (C/A) code at bit or 'chipping' rate of 1.023 MHz (i.e., each millisecond there are 1023 modulated bits or 'chips' transmitted); and 2) the so-called 'P' code which has a chipping rate of 10.23 MHz or 10 times that of the C/A code. The L2 signal only contains the P code. GPS uses a PRN coding sequence of bits that have a specified length but have the property that different codes do not strongly correlate with one another (i.e., they are orthogonal). The C/A code is 1023 chips long and thus repeats every 1 millisecond. The full P code length is 38 weeks but is truncated to 1 week.

The control segment is responsible for the operation and maintenance of the GPS. There are five monitoring stations worldwide at Kwajalein, Hawaii, Colorado Springs, Diego Garcia and Ascension. These stations measure the discrepancies between the satellite state information (satellite positions and clock) as well as health of the satellites. The Master Control Station (MCS) in Colorado Springs formulates predicted values and uploads them to the satellites. This data is then included in the new message for broadcast to the users.

The user segment comprises GPS receivers that decode the satellite messages and determine the ranges to at least four GPS SVs to determine 3-dimensional position and the receiver clock offset. Users breakdown into two main groups: authorized and unauthorized. Authorized users have full access to both the C/A and P codes. Authorized users are restricted to the military and other special groups or projects with special permission from the DoD. Unauthorized users generally cannot access the P codes as the code itself is encrypted before broadcast by a process known as anti-spoofing (AS). This makes the process of emulating a GPS signal to the authorized user more difficult. The encrypted modulated signal is known as Y code. Additionally the hand-over-word (HOW) between the C/A and Y code is also encrypted. Authorized users are given a 'key' that allows for the decryption of the HOW as well as the Y code. Authorized user receiver equipment with dual frequency code access uses what is known as the Precise Positioning Service (PPS).

GPS receivers are very sensitive devices capable of measuring the low signal levels available on, or near, the surface of the Earth. A GPS receiver design incorporates radio-frequency (RF) elements, signal downconversion, signal sampling, digital signal processing, as well as computational devices and methods. The first element of the GPS receiver that interacts with the satellite signal is the antenna. The antenna is a RF component that converts the signal present in the air to an electrical signal which is processed by the receiver.

There are many aspects that are important in antenna design that include, but are not limited to, the following: 1) frequency or frequencies of maximum sensitivity; 2) polarization; 3) size; 4) shape; 5) bandwidth; and 6) gain pattern. Depending on the goals of a particular GPS receiver, various antenna design aspects are emphasized or de-emphasized.

Given the above general background of GPS, a variety of GPS receivers have been developed to fill various market niches. One of these markets is personal GPS.

The idea of using a device on or near the human body that is capable of receiving and processing global positioning system (GPS) signals is impractical for the current state of the art. Such a prior art device, if comprised solely of prior-art components, would experience significant difficulty in receiving clear and processable GPS signals. Such difficulty is directly attributable to the fact that the antenna of such a device would be excessively sensitive to gain variations when in the proximity of a human body. In addition, such a prior-art antenna that may incorporate patch elements or micro-strips may be excessively sensitive to the location of a GPS signal source.

The above description relates to problems and disadvantages relating to tracking, logging, and analysis of personal activities, such as position determination of a user of a cellular telephone. These problems can also be seen for blockage conditions inside of cars or trucks as well as other vehicular applications. Other obstructions such as building or trees can have their influence lessened by this novel device as well.

SUMMARY OF THE INVENTION

In accordance with the present invention, an antenna arrangement for a GPS signal processing device having a circuit board is disclosed.

In a preferred embodiment of the invention, the arrangement comprises an antenna member mounted to the circuit board. The antenna member includes a first surface, a second surface and a third surface. The third surface adjoins the first and second surfaces. The first, second and third surfaces define a cavity within which is disposed dielectric material. At least one conductive connector comprising first and second ends is in communication with the antenna member first surface. An amplifier is in communication with each conductive connector second end.

The relatively compact size of the cavity antenna design allows for the incorporation of the antenna into a small device that can be worn on or carried in close proximity to the body of a user. This type of antenna is not as sensitive to gain variations when in the proximity of a human body. In fact, the performance of the antenna's gain pattern can be tuned using the assumption that it is close to the human body. Further, this type of antenna is virtually omni-directional, i.e., it is not problematically sensitive to the location of the GPS signal source. Moreover, the design is such that the antenna arrangement can be oriented within a device in a way that maximizes the number of GPS satellites tracked.

These and other features of the invention are detailed in the following description and accompanying drawings.

DETAILED DESCRIPTION OF THE INVENTION

For an application where the GPS receiver will be used on or near the human body, an omni-directional (or homogenous) gain pattern is of high concern. This is because satellites may be partially obstructed by the person using the receiver, decreasing the signal level received at the antenna. If the direction of the weak signal reception corresponds to a deep null of the antenna, then the signal may not be able to be tracked. Having an antenna with nearly omni-directional gain, as does the present invention, helps to avoid such a condition. If a GPS receiver is used in coordination with wireless communications device, such as a cellular phone, inadvertent signals from the device could interrupt the GPS signals. For this reason, many GPS receivers employ an electrical filter or filters to isolate the GPS signals from interference sources. Having an antenna with a very narrow bandwidth around the desired GPS frequencies, as does the present invention, reduces or eliminates the need for such filtering, which reduces the cost of components. In many cases, having small size is critical for ergonomic or other mechanical design constraints. Additionally, having flexible shape is a desirable feature for mechanical integration. In summary, the current invention represents an antenna that has the following desirable characteristics: 1) sensitivity at the GPS L1 frequency; 2) narrow bandwidth around the GPS L1 frequency; 3) small profile; 4) flexible shape; 5) omni-directional gain pattern; and 6) mountable on printed circuit board.

Figure 1:
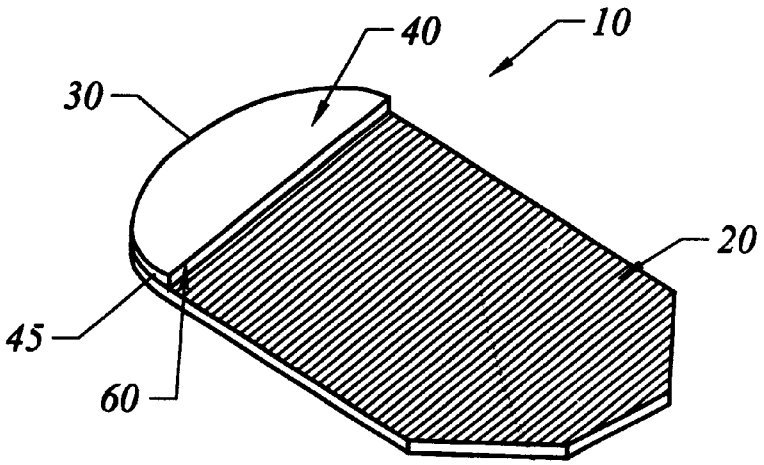
FIG. 1 is an upper perspective view of a global positioning system (GPS) signal processing device incorporating features of the present invention.

FIG. 1 shows in an upper perspective view a global positioning system (GPS) signal processing device 10 incorporating features of the present invention. Device 10 includes a circuit board 20 comprising GPS receiver circuitry (not shown) adapted to amplify, acquire and track GPS signals. Disposed upon board 20 is an antenna member 30. Antenna member 30 comprises an upper surface 40, a bottom surface 50 (best shown in FIG. 2) and a side surface 60 adjoining upper surface 40 and bottom surface 50. Surfaces 40, 50 and 60 serve to define a cavity 45. In the preferred embodiment of the invention, surfaces 40, 50 and 60 are composed of a conductive material such as copper, aluminum, tin, or of other suitable type well known in the art. The conductive material of which surfaces 40, 50, 60 are composed may be identical or may vary from surface to surface. Further, surfaces 40, 50 can be rounded in configuration. Such a rounded configuration (as opposed to other rectangular or parallelepiped configuration) is an improvement over the prior art because it can allow greater flexibility in packaging and mechanical design.

The dimensions of the antenna 30 may range as follows. The cavity 45 has a length of between 25 and 44 mm, nominally 28 mm, a width of between 22 and 44 mm, nominally 25 mm, and a height of between 1 and 4 mm, nominally 2 mm. The nominal dimensions are appropriate for receiving GPS signals.

One design consideration was reducing the cost and size of the GPS device 10. The cavity antenna 30 has a narrow bandwidth of approximately 2 MHz around the GPS L1 carrier frequency. The length of the cavity 45 determines the center frequency. The structure of the cavity antenna 45 gives the narrow bandwidth. Patch antennas and micro-strip antennas used in existing GPS receivers are sensitive over a much larger range of frequencies in general. Thus, having a narrow bandwidth eliminates the need for filters that would be required with existing patch or micro-strip antennas, reducing the size and cost of the GPS device 10.

Another design consideration was preventing interference due to the proximity of a user's body. With the cavity antenna 30, the bottom surface 50 may be disposed between the user's body and the cavity 45 such that the bottom surface 50 overlaps the upper surface 40 from the perspective of the user's body. The bottom surface 50 then functions as a ground plane and serves to isolate the antenna 30 from the effects of the proximity of the user's body. By eliminating these effects, the antenna has attributes of omni-directionality; that is, at any orientation the antenna receives the GPS signals without regard to orientation of the antenna 30. This overcomes the narrow aperture defect of existing micro-strip or patch antennas. The planar resonance of the cavity antenna 30 gives a wider aperture that is less susceptible to blockage due to the proximity of the user's body. Additionally, a directional design has polarization that makes it more sensitive to the GPS signal in a given direction. The critical factor when directionality is concerned is the signal environment. If the environment is clear sky (direct visibility of the GPS satellites) then there is a benefit of up to 3 dB from a directional design (assuming the most sensitive axis can be aligned with the general direction of the satellites). If you have a blocked or reflected path then there is usually not a great advantage in a having a directional design. The polarity of reflected signals are reversed which has a deleterious effect on the directional design. The omnidirectional design of the present invention is not susceptible to this reversed polarity.

Figure 2:
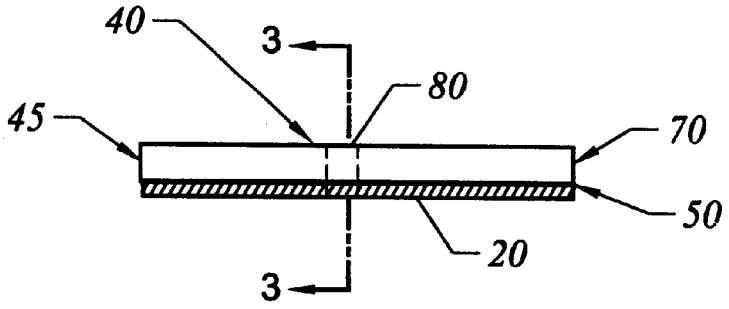
FIG. 2 is frontal plan view of the device of FIG. 1.

FIG. 2 is a frontal view of device 10. As shown therein, the cavity 45 formed in part by and between surfaces 40, 50 is filled with dielectric material 70. The preferred dielectric material in the cavity 45 is a material having a dielectric constant of at least 3.

Figure 3:
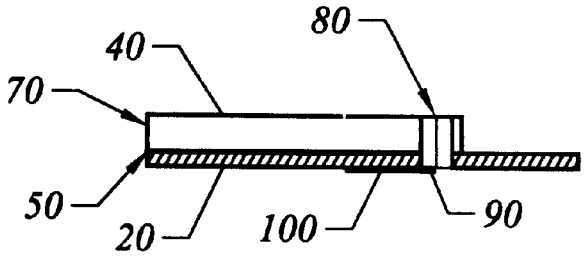
FIG. 3 is a partial side cross-sectional view taken along line 3—3 as shown in FIG. 2.
Figure 4:
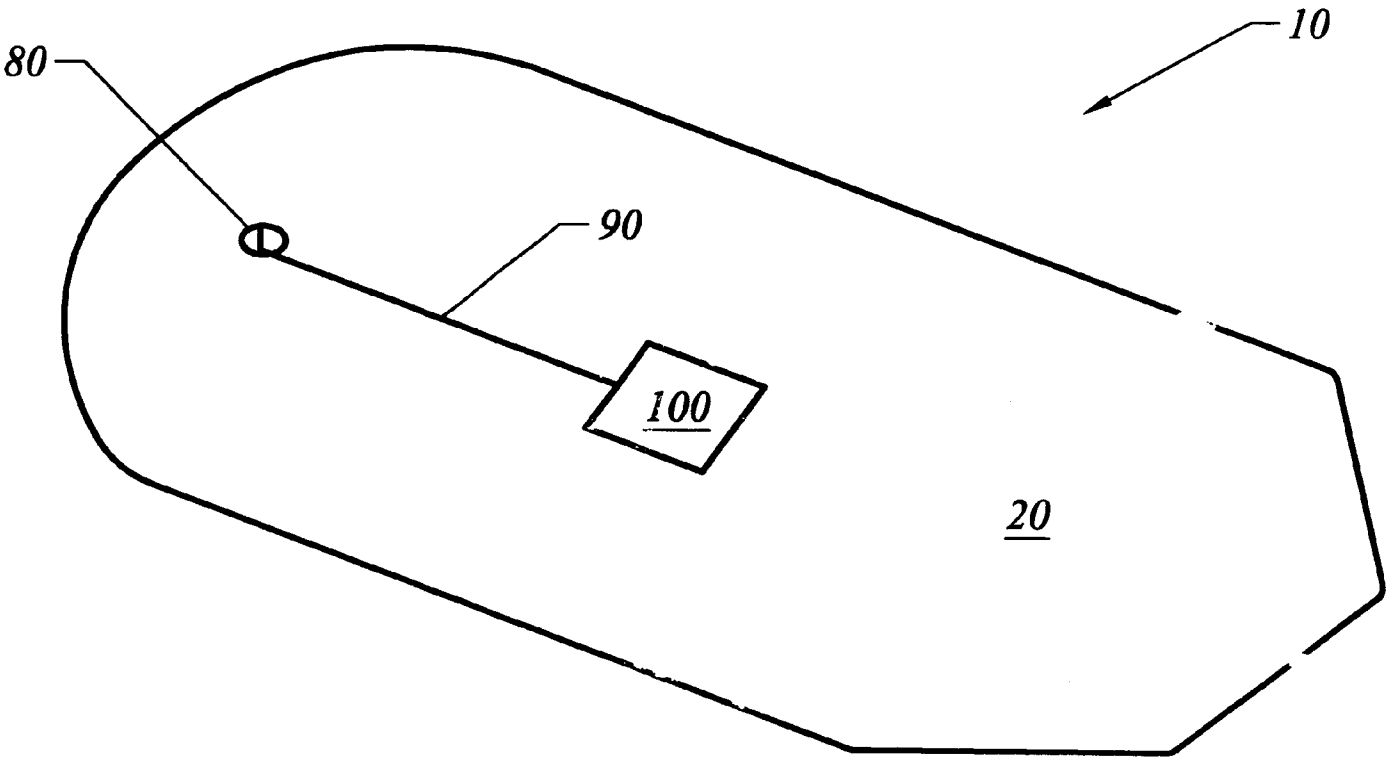
FIG. 4 is a lower perspective view of the device of FIG. 1.
Figure 5:
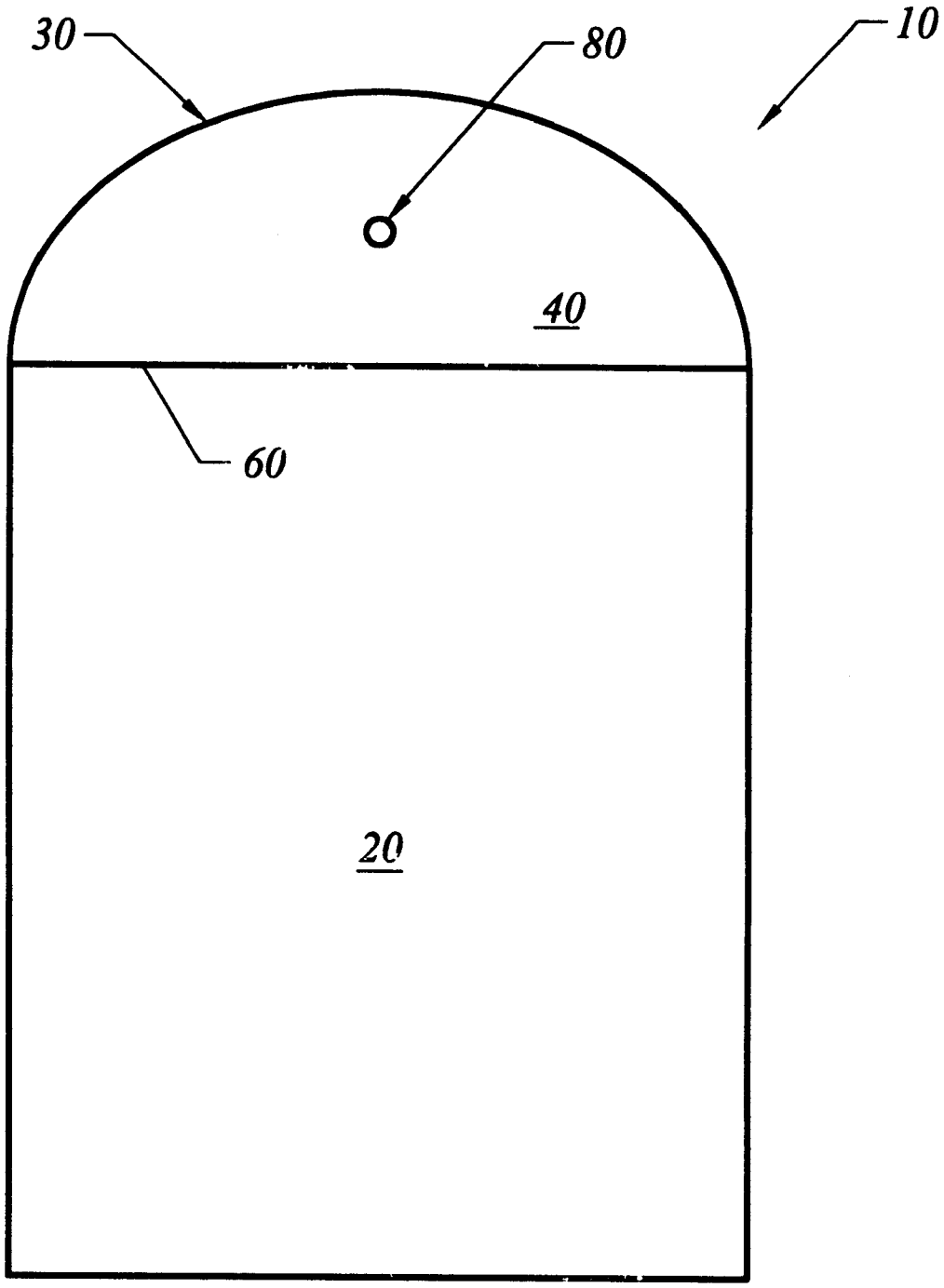
FIG. 5 is an upper plan view of the device of FIG. 1.

As best shown in FIG. 3 and shown in phantom lines in FIGS. 2 and 5, an aperture 80 is formed through board 20, surface 50 and dielectric material 70. A conductive feedline connector 90 is connected at a first end to surface 40 and at a second end to a low noise amplifier (LNA) 100. LNA 100, in turn, communicates with the GPS receiver circuitry of circuit board 20. In the preferred embodiment, LNA 100 is disposed along a lower surface of board 20, as best shown in FIG. 4.

The GPS receiver circuitry may include other features, such as a clock or other measuring components, and may combine that information with the GPS data for display or communication with other devices. The GPS receiver circuitry may be controlled by the user to perform various functions related to the GPS data or other features, or to adjust or select the information displayed by the device 10.

Aperture 80, and thus the connection between feedline connector 90 and surface 40, can be located anywhere along surface 40. By adjusting the location of the connection between feedline connector 90 and surface 40, the impedance and/or gain of antenna member 30 can be adjusted to match the input impedance and/or gain of LNA 100. Such adjustment allows for optimal functional configuration of device 10 in view of varying environments within which device 10 will be used. LNA 100 sets the gain of GPS signals received by antenna member 30 and carried by feedline connector 90 before input to the receiver circuitry.

The antenna 30 as can be seen from FIGS. 1–3 is preferably semi-circular in profile. Other profile shapes that may be used for the antenna 30 include a semi-oval or square profile. The upper surface 40, bottom surface 50 and side surface 60 form what may be referred to as a "taco shell" structure for the antenna 30.

Alternatively, the side surface 60 may be replaced with multiple vias (or conductive pass-through slots) along the edge of the antenna 30. This aids in the manufacturability of the antenna 30 because it reduces the cost of coating three sides of a circuit board, and reduces the labor involved in soldering the side surface 60 around the edges of the upper surface 40 and bottom surface 50.

The above-described embodiment is ideal for receiving and processing linearly-polarized GPS signals.

Figure 6:
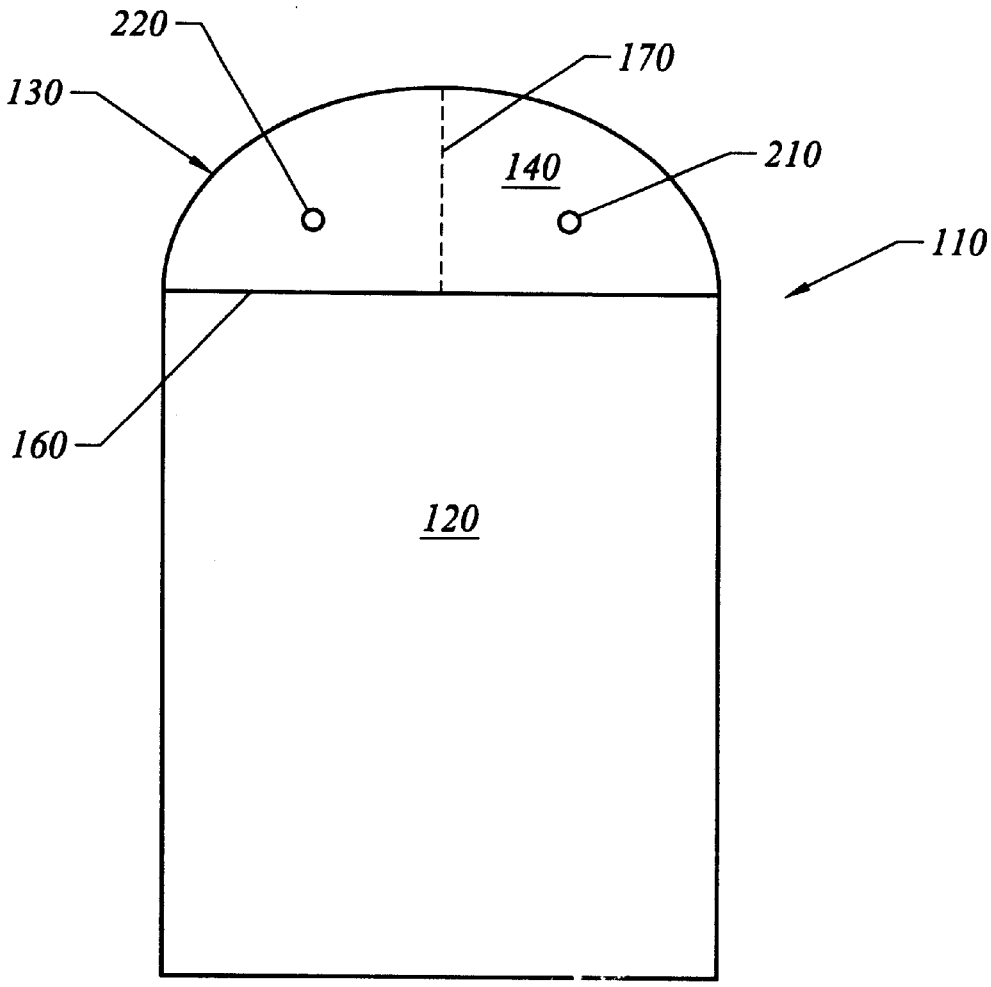
FIG. 6 is an upper plan view of an alternative embodiment incorporating features of the present invention.
Figure 7:
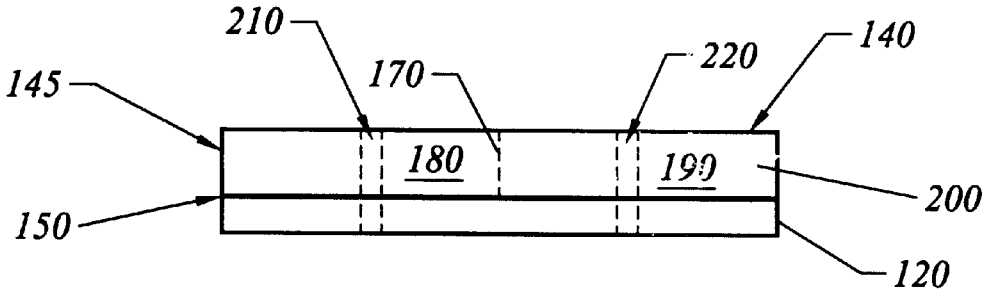
FIG. 7 is a frontal plan view of the device of FIG. 6.
Figure 8:
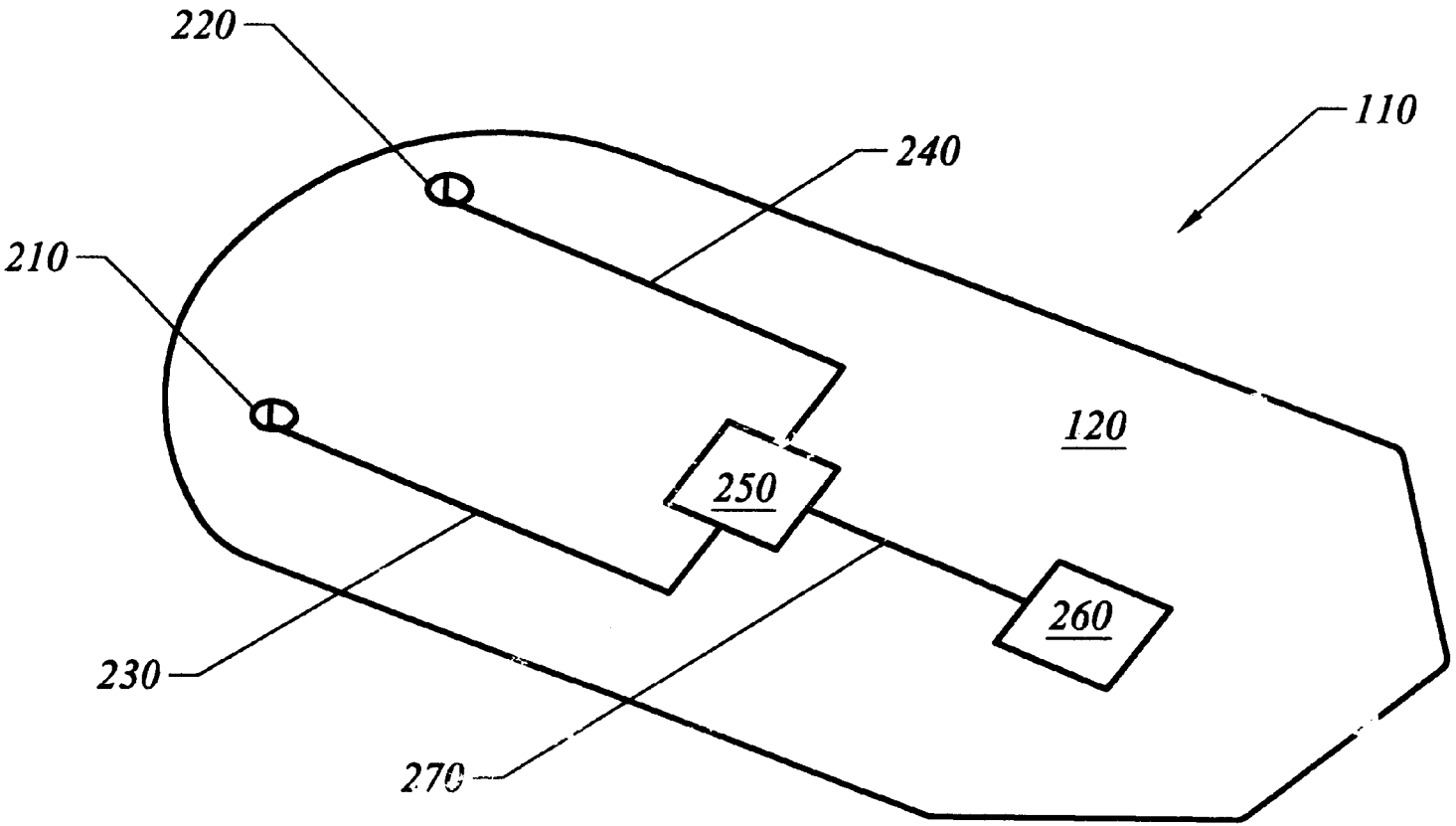
FIG. 8 is a lower perspective view of the device of FIG. 6.

FIGS. 6–8 illustrate an alternative embodiment of the present invention. A GPS signal processing device 110 includes a circuit board 120 comprising GPS circuitry (not shown) adapted to amplify, acquire and track GPS signals. Disposed upon board 120 is an antenna member 130. Antenna member 130 comprises an upper surface 140, a bottom surface 150 (best shown in FIG. 7) and a side surface 160 adjoining upper surface 140 and bottom surface 150. Surfaces 140, 150 and 160 define a cavity 145. In the preferred embodiment of the invention, surfaces 140, 150 and 160 are composed of a conductive material as described above in connection with the preferred embodiment. The conductive material of which surfaces 140, 150, 160 are composed may be identical or may vary from surface to surface. Further, surfaces 140, 150 are semi-circular in configuration.

FIG. 7 is a frontal view of device 110. As shown therein, cavity 145 formed in part by and between surfaces 140, 150 is separated into chambers 180, 190 by a wall 170. Wall 170 contacts both surfaces 140, 150. Preferably, wall 170 is composed of conductive material identical to or different from that of which surfaces 140, 150, 160 are comprised. Chambers 180, 190 are filled with dielectric material 200 as described above in connection with the preferred embodiment. Apertures 210, 220, shown in phantom lines in FIGS. 6 and 7, are formed through board 120, surface 150 and dielectric material 200 disposed within chambers 180, 190. Conductive feedline connectors 230, 240 are connected at their first ends to surface 140 through, respectively, apertures 210, 220. Connectors 230, 240 are connected at their second ends to a filter 250. Filter 250 selectively phases the GPS signals carried by feedline connectors 230,240. Filter 250, in turn, communicates such phased GPS signals to a LNA 260 via a conductor 270. LNA 260 communicates with the GPS receiver circuitry of circuit board 120. LNA 260 sets the gain of such phased GPS signals before input to the receiver circuitry.

Apertures 210, 220, and thus the connection between feedline connectors 230, 240 and surface 140, can be located anywhere along surface 140 within their respective chambers 180, 190. The location adjustments of the connection between feedline connectors 230,240 and surface 140 impacts the impedance and/or gain of antenna member 130 in a manner similar to that of the above-described preferred embodiment.

By employing the phasing function of filter 250, the above-described alternative embodiment is ideal for receiving and processing circularly-polarized GPS signals. Such phasing inserts delays in one or both of the signals carried by either or each of feedline connectors 230, 240 to ensure that when such signals are combined, the overall sensitivity of antenna member 130 is highest for a circularly-polarized signal. In configuring device 110 to receive circularly-polarized signals, the effective gain of antenna member 130 is increased by three decibels.

Figure 9:
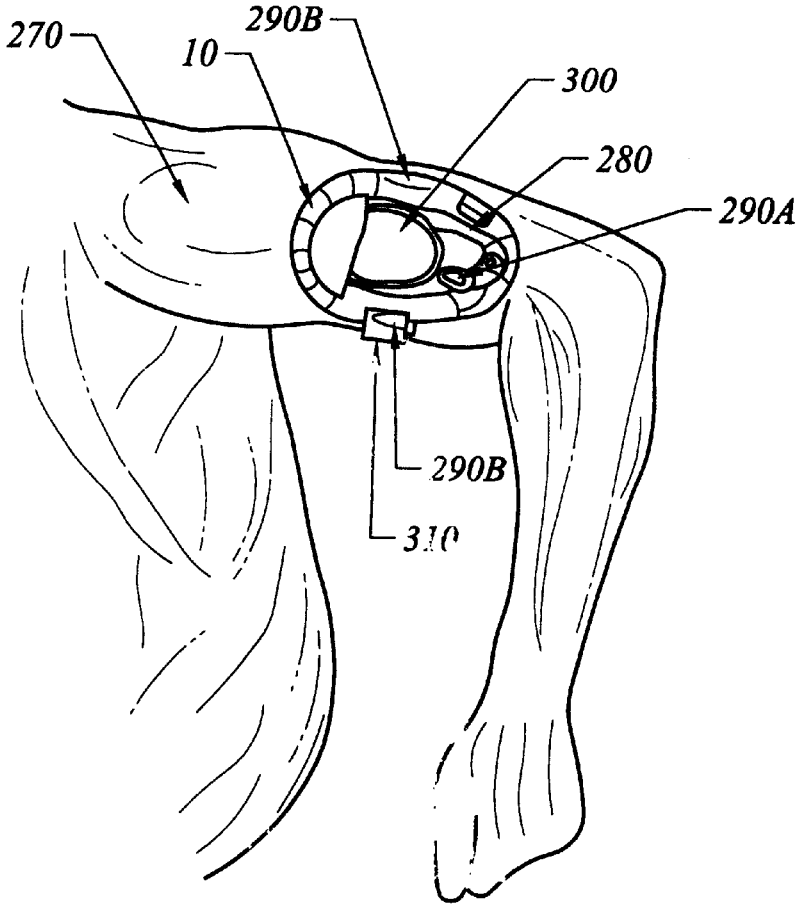
FIG. 9 is a plan view of a device incorporating features of the present invention and worn by an athlete.

FIG. 9 shows in plan view an exemplary employment of device 10 by an athlete 270 desiring performance feedback. Device 10 is enclosed within a housing 280. When so disposed within housing 280, device 10 cooperates with controllers, such as a switch 290A and/or buttons 290B in order to supply athletic performance feedback to athlete 270 via a display 300. In the preferred embodiment, housing 280 is attached to the arm of athlete 270 by means of a strap 310 or other appropriate securing device.

Figure 10:
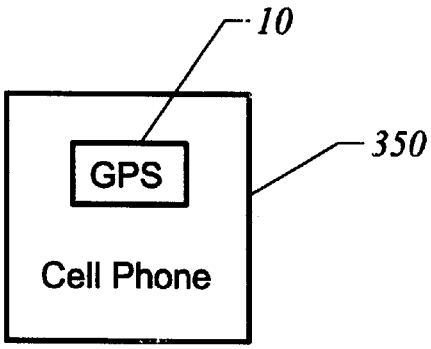
FIG. 10 is a block diagram of a cellular telephone incorporating features of the present invention.

FIG. 10 is a block diagram showing that the GPS device 10 may be incorporated into a cellular telephone 350. As described above, the problems involved in receiving GPS signals when in proximity to the user's body are also present when attempting to receive GPS signals in a hand-held device such as a cellular telephone. The GPS device 10 according to the present invention is also useful in these devices.

Although the invention has been described in terms of the illustrative and an alternative embodiment, it will be appreciated by those skilled in the art that various changes and modifications may be made to the illustrative embodiment without departing from the spirit or scope of the invention. For example, surfaces 40, 50 may be semi-ovular or polygonal in configuration. In addition, surface 60 may be replaced by a plurality of conductive vias connecting surfaces 40, 50.

In addition, a plurality of apertures similar to aperture 80 can be disposed along surface 40 so as to allow selective placement of the connection between feedline connector 90 and surface 40. In addition, antenna member 30 may be disposed on either side of board 20 relative to athlete 270 wearing device 10. It is intended that the scope of the invention not be limited in any way to the illustrative or alternative embodiment shown and described but that the invention be limited only by the claims appended hereto.

What is claimed is:

1. An antenna arrangement for a GPS signal processing device having a circuit board, the arrangement comprising:

an antenna member mounted to the board, said member comprising a first surface, a second surface, and a third surface adjoining said first and second surfaces, said first, second and third surfaces defining a cavity, said member further comprising dielectric material disposed within said cavity, said member having said dielectric material exposed on three sides and contained on three sides;

at least one conductive connector comprising first and second ends, each first end thereof in communication with said first surface; and an amplifier in communication with each second end of said at least one conductive connector.

2. The apparatus of claim 1, wherein:

said first surface is semi-circular in configuration.

3. The apparatus of claim 1, wherein:

said second surface is semi-circular in configuration.

4. The apparatus of claim 1, wherein:

said first surface is conductive.

5. The apparatus of claim 1, wherein:

said second surface is conductive.

6. The apparatus of claim 1, wherein:

said third surface is conductive.

7. The apparatus of claim 1, wherein:

said first surface is spaced apart from said second surface.

8. The apparatus of claim 1, wherein:

said connector passes through said cavity, said second surface and the board.

9. The apparatus of claim 1, wherein:

said amplifier is a low-noise amplifier.

10. The apparatus of claim 1, further comprising:

a filter in communication with said amplifier, each second end of said at least one conductive connector in communication with said filter.

11. The apparatus of claim 1, wherein said antenna member has a semi-oval profile.

12. The apparatus of claim 1, wherein said antenna member has a square profile.

13. The apparatus of claim 1, wherein said antenna member forms a taco shell structure.

14. The apparatus of claim 1, wherein said antenna member receives GPS signals regardless of orientation.

15. The apparatus of claim 1, wherein said antenna member is omni-directional.

16. The apparatus of claim 1, wherein said dielectric material has a dielectric constant of at least 3.

17. The apparatus of claim 1, wherein said antenna member has a narrow bandwidth around a GPS L1 carrier frequency.

18. The apparatus of claim 1, wherein said narrow bandwidth is approximately 2 MHz.

19. An antenna arrangement for a GPS signal processing device having a circuit board, the arrangement comprising:

an antenna member mounted to the board, said member comprising a first surface, a second surface, and a third surface adjoining said first and second surfaces, said first, second and third surfaces defining a cavity, said member further comprising dielectric material disposed within said cavity;

at least one conductive connector comprising first and second ends, each first end thereof in communication with said first surface; and an amplifier in communication with each second end of said at least one conductive connector, wherein said member further comprises at least one wall disposed between said first and second surfaces, said at least one wall separating a plurality of chambers within said cavity.

20. The apparatus of claim 19, wherein:

said at least one wall is conductive.

21. The apparatus of claim 19, wherein:

a first one of said at least one connector first ends is disposed within a corresponding one of said plurality of chambers; and at least one additional one of said connector first ends is disposed within a corresponding additional one of said chambers.

22. An antenna arrangement for a GPS signal processing device having a circuit board, at least one conductive connector and an amplifier, the arrangement comprising:

an antenna member mounted to the board, said member comprising a first surface, a second surface, and a third surface adjoining said first and second surfaces, said first, second and third surfaces defining a cavity, said member further comprising dielectric material disposed within said cavity, said member having said dielectric material exposed on three sides and contained on three sides.

23. The apparatus of claim 22, wherein:

said first surface is semi-circular in configuration.

24. The apparatus of claim 22, wherein:

said second surface is semi-circular in configuration.

25. The apparatus of claim 22, wherein:

said first surface is conductive.

26. The apparatus of claim 22, wherein:

said second surface is conductive.

27. The apparatus of claim 22, wherein:

said third surface is conductive.

28. The apparatus of claim 22, wherein:

said first surface is spaced apart from said second surface.

29. The apparatus of claim 22, wherein:

the at least one connector is in communication with said first surface.

30. The apparatus of claim 22, wherein:

the connector passes through said cavity, said second surface and the board.

31. An antenna arrangement for a GPS signal processing device having a circuit board and to be disposed in close proximity to the body of a user, the arrangement comprising:

an antenna member mounted to the board, said member comprising a first surface, a second surface, and a third surface adjoining said first and second surfaces, said first, second and third surfaces defining a cavity, said member further comprising dielectric material disposed within said cavity, said member having said dielectric material exposed on three sides and contained on three sides;

at least one conductive connector comprising first and second ends, each first end thereof in communication with said first surface; and an amplifier in communication with each second end of said at least one conductive connector.

* * * * *